US005938966A

United States Patent [19]

Oh et al.

[11] Patent Number: 5,938,966

[45] Date of Patent: Aug. 17, 1999

[54] APPARATUS FOR AND METHOD OF CONTROLLING COOKING OPERATION OF MICROWAVE OVENS USING CODE SYSTEM

[75] Inventors: Sang-Hun Oh; Jeong-Seok Jo, both of Changwon, Rep. of Korea

[73] Assignee: LG Electronics Inc., Seoul, Rep. of Korea

[21] Appl. No.: 08/903,152

[22] Filed: Jul. 30, 1997

[30] Foreign Application Priority Data

Feb. 26, 1997 [KR] Rep. of Korea ..... 5967/97

[51] Int. Cl.[6] ..... H05B 6/68

[52] U.S. Cl. ..... 219/702; 219/714; 219/720; 99/325

[58] Field of Search ..... 219/702, 714, 219/720, 708; 99/325; 364/477.05

[56] References Cited

U.S. PATENT DOCUMENTS 4,323,773 4/1982 Carpenter ..... 219/714
5,426,280 6/1995 Smith ..... 219/714

FOREIGN PATENT DOCUMENTS 61-22132 1/1986 Japan ..... 219/702

*Primary Examiner*—Philip H. Leung

[57] ABSTRACT

An apparatus for and a method of controlling the cooking operation of a microwave oven using a code system, wherein a desired cooking is simply and conveniently carried out in an optimum state in accordance with a cooking code consisting of numerals or characters which are set by a simple key input manipulation of the user. Such cooking codes are indicated on packages of foods to be cooked so that the user inputs those cooking codes upon cooking the associated food items.

17 Claims, 4 Drawing Sheets

APPARATUS FOR AND METHOD OF CONTROLLING COOKING OPERATION OF MICROWAVE OVENS USING CODE SYSTEM

BACKGROUND OF THE INVENTION

1. Field of the Invention

The present invention relates to an apparatus for and a method of controlling the cooking operation of a microwave oven using a code system, and more particularly to such control apparatus and method wherein a desired cooking is simply and conveniently carried out in an optimum state in accordance with a cooking code having of numerals or characters which are input by a user.

2. Description of the Prior Art

Microwave ovens are well known as a cooking appliance that changes electricity into microwaves, thereby directly heating foods. Recently, a microwave oven having a multi-function has been proposed which additionally includes a heater adapted to directly change electricity into heat so as to have an additional function expected in a grill, oven or steamer.

Developments of such a multi-function microwave oven not only result from the demands of the multimedia times to obtain a variety of functions from a single appliance, but also result from developments of a variety of instant foods according to the demands of consumers to obtain convenience, simplicity and rapidity in use.

Such a multi-function microwave oven can be used not only in homes where a cooking appliance can be installed, but also in any place a necessary space for occupying the microwave oven is given and electricity is supplied, as in offices or supermarkets. In this regard, the use of such a multi-function microwave may extend greatly in the future.

In a conventional microwave oven shown in FIG. 1A, the cooking of food is carried out under the control of a microcomputer included in the microwave oven in accordance with a cooking mode and a cooking time both set by the user. That is, a desired cooking key is first selected for cooking the food (Step 1), as shown in FIG. 1B. A cooking time is then set by pressing numeral keys (Step 2). Thereafter, a cooking start key is depressed to input a cooking start key signal (Step 3). In response to the cooking start key signal, the microcomputer controls the microwave oven or heater to carry out a desired cooking operation for the set cooking time in the set cooking mode.

In such a conventional microwave oven, an automatic cooking mode is also used. For such an automatic cooking mode, the microwave oven is stored with data about a certain number of cooking menus which are preferred for general users. The automatic cooking mode is executed in response to an automatic cooking key signal generated when the user depresses an automatic cooking key under the condition in which food to be cooked is received in a cooking chamber. For cooking menus set for the automatic cooking mode, data about the cooking method, cooking time, output level, and cooking temperature, etc. are stored in the microcomputer. When the user selects one of the set cooking menus, a cooking operation in the automatic cooking mode is carried out, based on data about the cooking conditions associated with the selected cooking menu.

However, the conventional microwave oven has a limited cooking performance because of a limited capacity of the microcomputer included therein. Furthermore, there is a limitation in increasing the number of cooking menus for the automatic cooking mode due to a limited memory capacity.

Meanwhile, in the case of a manual cooking mode, there is inconvenience because the user should manually perform several key selections to set required cooking conditions such as cooking time, cooking temperature, cooking mode, and output level, etc. Moreover, in this case, it is difficult for the user to set optimum cooking conditions.

FIG. 2A illustrates another conventional microwave oven using a bar code reader system.

As shown in FIG. 2A, this microwave oven requires a cook book B recorded with a variety of cooking information in the form of bar codes, and a bar code reader R adapted to read a bar code associated with a desired cooking menu from the cook book B.

Where a cooking operation for a desired cooking menu is to be executed in such a microwave oven, a bar code associated with the cooking menu is read from the cook book B using the bar code reader R (Step 1 in FIG. 2B). A cooking start key signal is then input (Step 2). In response to the cooking start key signal, a desired cooking operation is executed, based on the read bar code. In this case, accordingly, it is possible to achieve a precise cooking operation.

In the case of such a microwave oven using the bar code reader system, however, it is impossible for the user to directly input bar codes for desired cooking menus. For this reason, the above-mentioned bar code reader R and cook book B are additionally needed in addition to the microwave oven. This results in an increase in costs. Furthermore, the configuration of the microwave oven is complex. Also, there is an inconvenience in use.

SUMMARY OF THE INVENTION

Therefore, an object of the invention is to provide an apparatus for and a method of controlling the cooking operation of a microwave oven using a code system, wherein a desired cooking is simply and conveniently carried out in an optimum state in accordance with a cooking code including numerals or characters which are set by a simple key input manipulation of the user.

Another object of the invention is to provide an apparatus for and a method of controlling the cooking operation of a microwave oven using a code system, which are capable of detecting an erroneous inputting of cooking codes.

Another object of the invention is to provide an apparatus for and a method of controlling the cooking operation of a microwave oven using a code system, which are capable of infinitely increasing the number of cooking menus for an automatic cooking mode in a simple manner without an increase in costs.

In accordance with an apparatus for and a method of controlling the cooking operation of a microwave oven using a code system, which accomplishes the above-mentioned and other objects of the present invention, a cooking code is used which has the form of numerals or characters recognizable by the user. The cooking code including elements respectively indicative of cooking information associated with cooking conditions. Such a cooking code, which is input by the user, is decoded. Based on the decoded data, an automatic cooking operation is carried out.

In accordance with the control apparatus and method of the present invention, optimum cooking conditions for an optional food item associated with the cooking mode, cooking time, cooking temperature and output level are calculated and encoded using simple numerals.

The control apparatus and method of the present invention provide a convenient and simple cooking method. That is, the cooking code indicative of cooking conditions is easily recognizable by the control system only by several key selections. Accordingly, it is possible to reduce the use of unnecessary keys. In addition, it is also possible to simplify the mechanical configuration of the control apparatus. A reduction in the manufacturing costs is also achieved.

In accordance with the control apparatus and method of the present invention, it is possible to detect an erroneous input of coded cooking information using an error detect code. Accordingly, an accurate cooking operation can be carried out in an optimum state.

In particular, an automatic cooking can be carried out for cooking menus not limited in number in accordance with the control apparatus and method of the present invention. The automatic cooking is executed in accordance with an input cooking code which is decoded in accordance with data about cooking conditions respectively associated with constituting elements of the cooking code. Accordingly, it is possible to increase the number of cooking menus for the automatic cooking in so far as there is a memory means stored with a variety of data associated with the constituting elements of the cooking code.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1A:
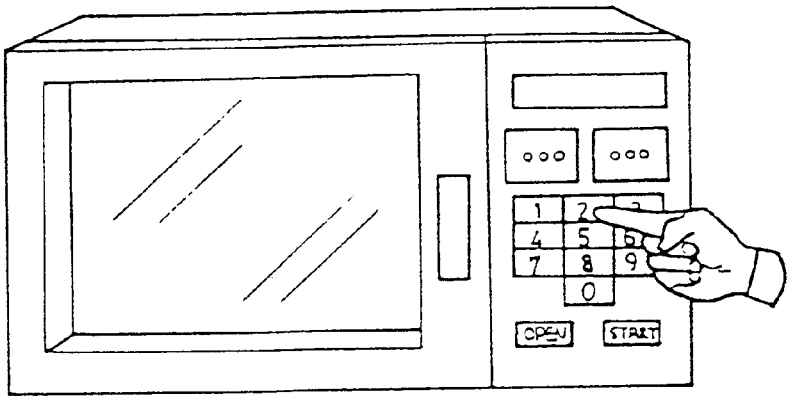
FIG. 1A (PRIOR ART)
FIGS. 1(A and 1(B) are views illustrating a conventional cooking control method carried out in a general microwave oven.
Figure 1B:
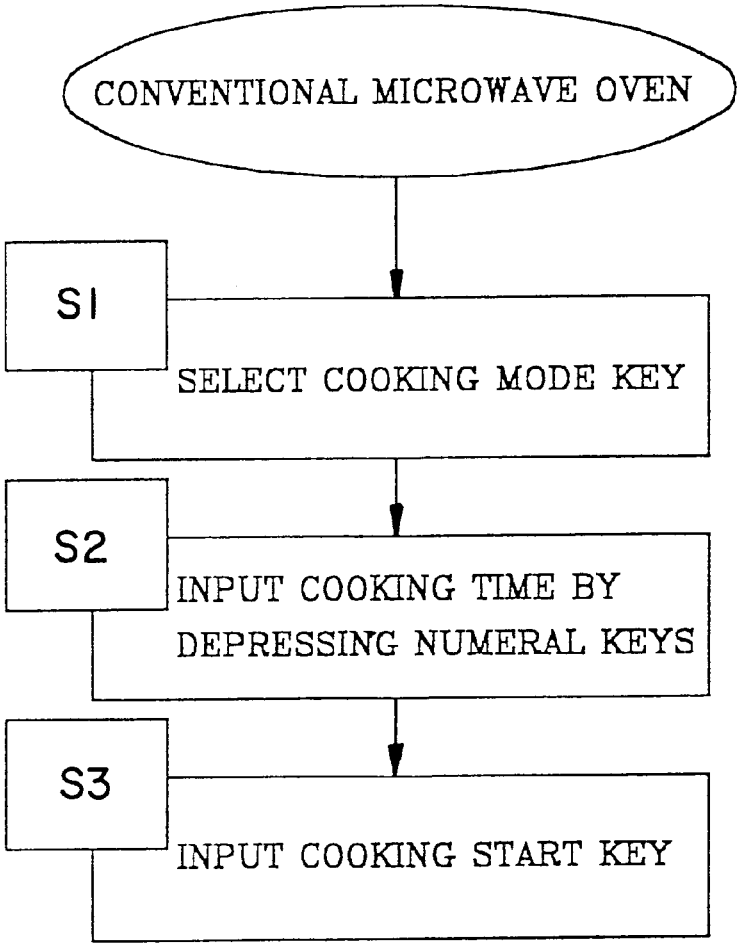
FIG. 1B (PRIOR ART)
Figure 2A:
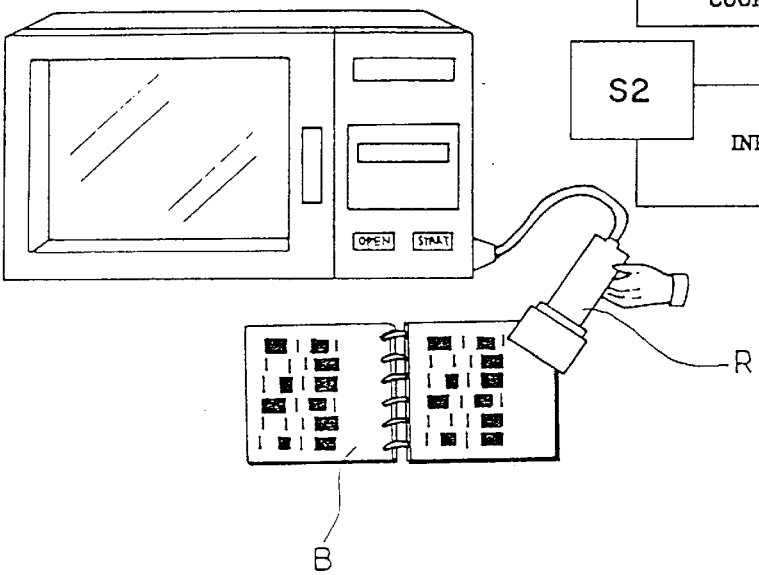
FIG. 2A (PRIOR ART)
FIGS. 2(A) and 2(B) are views illustrating another conventional cooking control method carried out in a microwave oven using a bar code reader system.
Figure 2B:
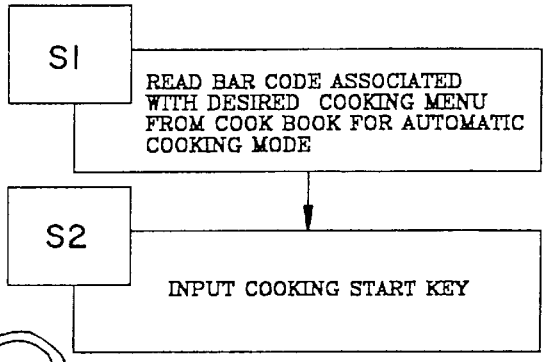
FIG. 2B (PRIOR ART)
Figure 3:
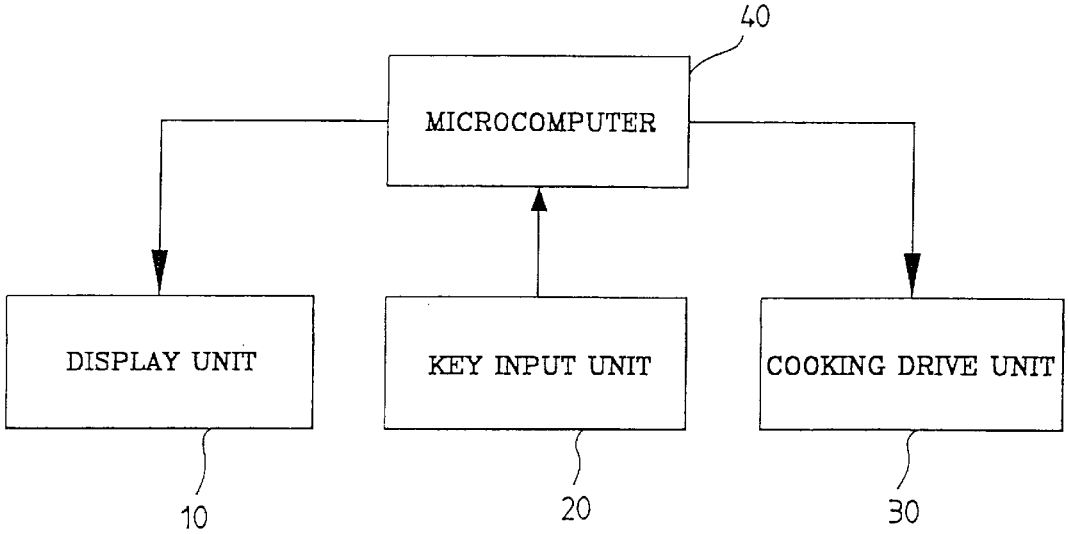
FIG. 3 is a block diagram illustrating the hardware configuration of a microwave oven using a code system in accordance with the present invention.

FIG. 3 illustrates the hardware configuration of a microwave oven using a code system in accordance with the present invention.

As shown in FIG. 3, the microwave oven includes a key input unit 20 provided with a plurality of function keys including manual and automatic cooking mode keys, numeral keys and character keys. In this configuration, the user manually inputs cooking codes by manipulating selected function keys on the key input unit 20.

The microwave oven also includes a microcomputer 40 adapted to detect a key signal input from the key input unit 20 while controlling peripheral devices to execute a function associated with the detected key signal. The microcomputer 40 also detects a cooking code input by the user via the key input unit 20 and reads the detected code, thereby executing a control for performing an optimum cooking.

The microcomputer 40 basically includes a memory configured to store data, a control unit for controlling the memory and other components of the microcomputer 40, and a decoding unit adapted to decode a cooking code input to the microcomputer 40. The memory unit is stored with cooking information associated with cooking conditions which will be expressed by constituting elements of a cooking code. When a cooking code is input, the cooking information is referred to for the decoding of the input cooking code. That is, data according to the input cooking code is read for reference.

The microwave oven further includes a display unit 10 for displaying the cooking code set by the user and the current condition of the system received from the microcomputer 40, and a cooking drive unit 30 for controlling the output level of the microwave oven or heater under the control of the microcomputer 40.

Now, the operation of the above-mentioned control apparatus for the microwave oven using the code system in accordance with the present invention will be described, along with a cooking control method carried out using the control apparatus of the present invention.

Figure 4:
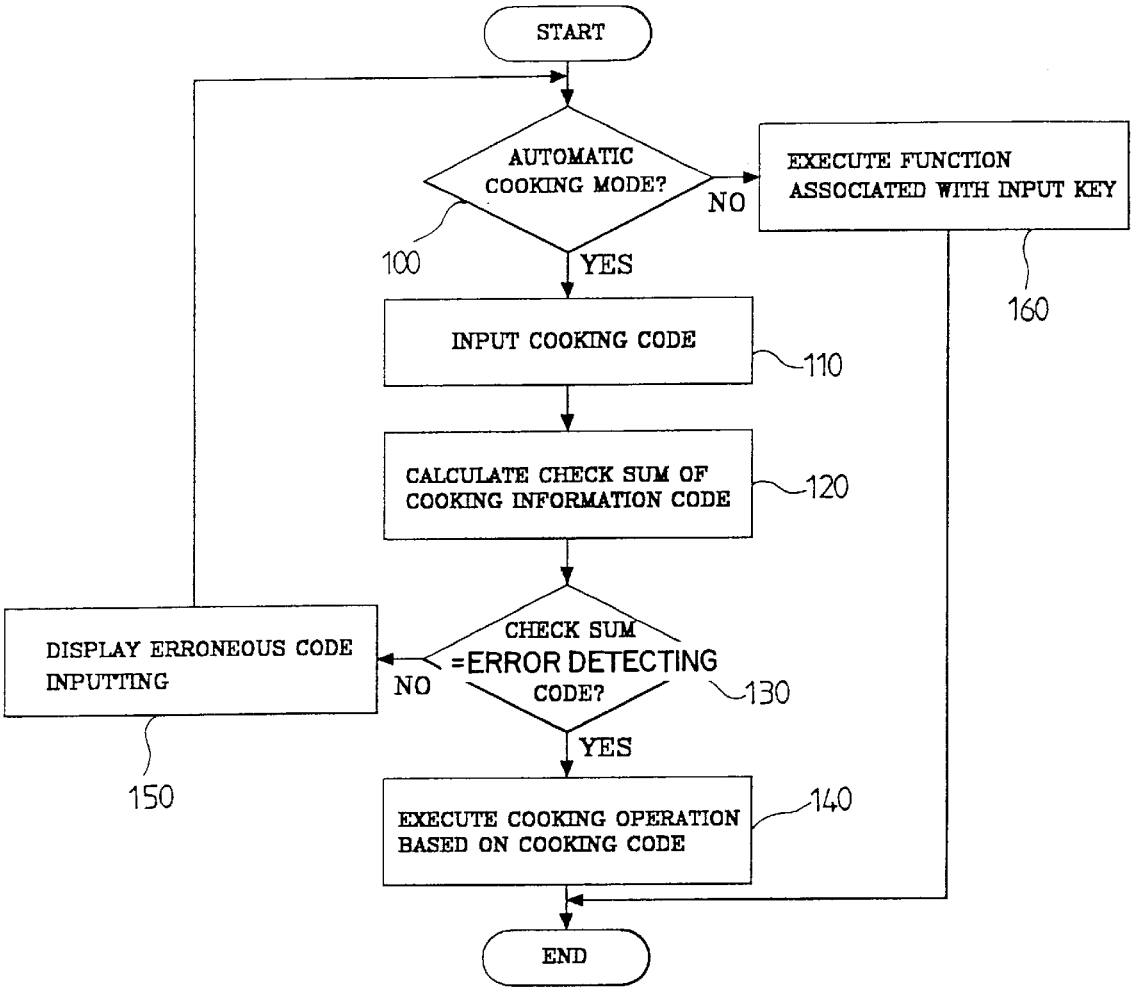
FIG. 4 is a flow chart illustrating sequential steps of a cooking control method carried out in the microwave oven using the code system in accordance with the present invention.

FIG. 4 is a flow chart illustrating sequential steps of the cooking control method carried out in the microwave oven using the code system in accordance with the present invention.

Prior to describing the cooking control method according to the present invention, constituting elements of a cooking code associated with an optional cooking menu will be described.

Cooking codes may be formed using various methods as long as they are standardized to basically include a code associated with cooking mode, cooking time, output level (e.g., heating power level) and cooking temperature, and an error detect code.

For instance, a cooking code may include a 7-digit cooking code and a 1-digit error detecting code expressed as follows:

| | | |
|---|---|---|
| Cooking code | 1 0 2 4 0 1 2 | 3 |
| | (1) | (2) |

(1): Cooking information code (2): Error detecting

Figure 5:
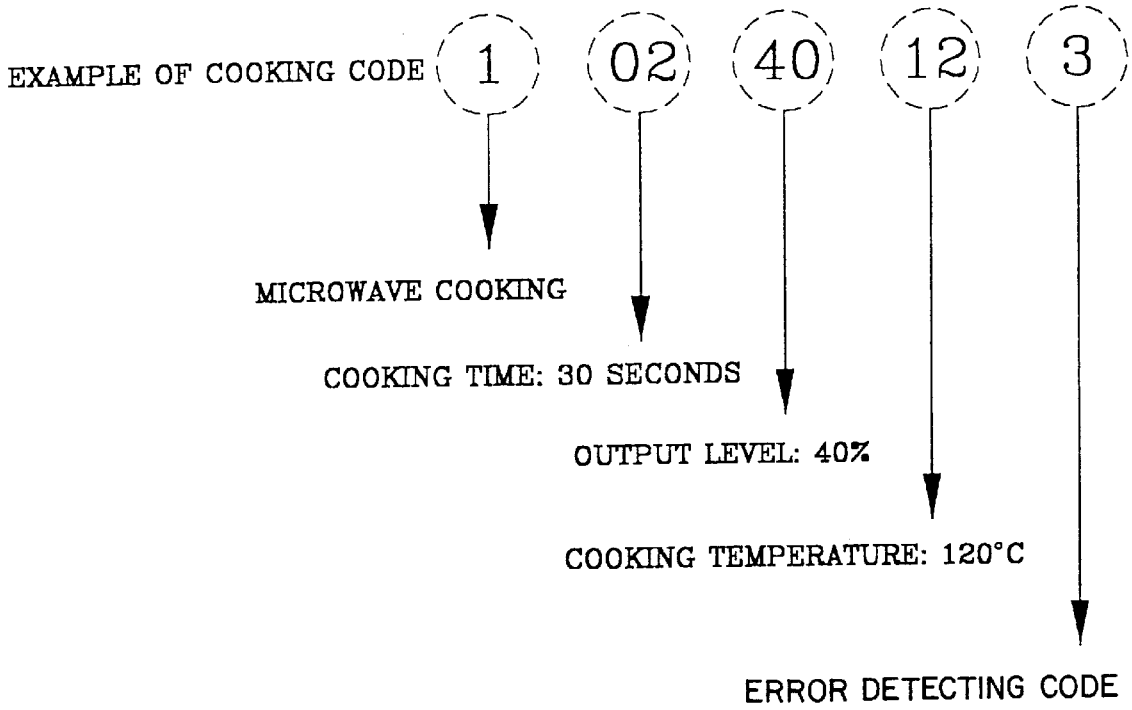
FIG. 5 is a view showing the format of a cooking code used in the method of FIG. 4.

This cooking code is also shown in FIG. 5.

The first digit of the cooking code is indicative of a "cooking mode". The first digit of "1" is indicative of a microwave cooking mode, "2" a grill cooking mode, "3" a heater cooking mode, and "4" a microwave/grill combination cooking mode. Other numerals of the first digit may be indicative of other cooking modes, respectively. Accordingly, the cooking mode indicated by the illustrated cooking code "1 0 2 4 0 1 2 3" are the microwave cooking mode.

The second and third digits of the cooking code is indicative of a "cooking time". Although the cooking time may be set using various methods, it is set by using two digits in accordance with the present invention. The second and third digits of "01" is indicative of a cooking time of 20 seconds, "02" 30 seconds, "03" 40 seconds, "04" 1 minute, "11" 1 minute and 20 seconds, "12" 1 minute and 30 seconds, "13" 1 minute and 40 seconds, "14" 2 minutes, "31" 2 minutes and 20 seconds, "32" 2 minutes and 30 seconds, "33" 2 minutes and 40 seconds, and "34" 3 minutes. Other numerals of the second and third digits may be indicative of other cooking times, respectively. Accordingly, the cooking time indicated by the illustrated cooking code "1 0 2 4 0 1 2 3" is 30 seconds.

The fourth and fifth digits of the cooking code are indicative of an "output level". Although the output level may also be set using various methods, it is set by using two digits in accordance with the present invention. The fourth and fifth digits of "01" are indicative of an output level of 10%, "02" 20%, "03" 30%, . . . , "09" 90%, and "10" 100%. Accordingly, the output level indicated by the illustrated cooking code of "1 0 2 4 0 1 2 3" is 40%.

The sixth and seventh digits of the cooking code are indicative of a "cooking temperature". Although the cooking temperature may also be set using various methods, it is set by using two digits in accordance with the present invention. The sixth and seventh digits of "10" are indicative of a cooking temperature of 100° C., "15" 150° C., "23" 230° C., and "43" 430° C. Other numerals of the sixth and seventh digits may be indicative of other cooking temperatures, respectively. Accordingly, the cooking temperature indicated by the illustrated cooking code of "1 0 2 4 0 1 2 3" is 120° C.

Finally, the eighth digit, "3", of the cooking code is indicative of an error detecting code.

Although the cooking code is composed of 8 digits in the illustrated case, it is not limited to such 8 digits. It is important for the cooking code to include a cooking information code having at least one numeral or character, and an error detecting code having at least one numeral or character.

The cooking information code of the cooking code is a code set in accordance with the kind of a food to be cooked so that the food can be cooked in an optimum state. The error detecting code has a value calculated on the basis of the arrangement of the numerals or characters of the cooking information code and the values of those numerals or characters.

Values of the constituting elements of such a cooking information code are previously set. These values are stored in the memory means (not shown) included in the microcomputer 40. Such data should be always reserved, irrespective of whether or not the microwave oven is supplied with electric power.

Now, the cooking control method of the present invention will be described in conjunction with the illustrated cooking code "1 0 2 4 0 1 2 3".

When the user selects an optional key on the key input unit 20, the microcomputer 40 determines whether or not the input key corresponds to the automatic cooking mode select key (Step 100 of FIG. 4).

Where it is determined at step 100 that the input key does not correspond to the automatic cooking mode select key, the microcomputer 40 controls peripheral devices to execute a function associated with the selected key (Step 160 of FIG. 4).

Where it is determined at step 100 that the input key corresponds to the automatic cooking mode select key, that is, where the automatic cooking mode is selected, the user manually inputs a cooking code for an automatic cooking by manipulating numeral keys and character keys on the key input unit 20 (Step 110 of FIG. 4).

The microcomputer 40 then recognizes the cooking code input by the user and displays the recognized cooking code on the display unit 10. At the same time, the microcomputer 40 divides the cooking code into a cooking information code and an error detecting code. The microcomputer 40 then derives an error detecting code value CHECK SUM based on values of elements of the cooking information code in accordance with a selected error detecting code calculation method (Step 120 of FIG. 4). Although the error detecting code value may be derived using various methods, the following method is used in accordance with the present invention.

First, the cooking code, which is "1 0 2 4 0 1 2 3" in the illustrated exemplary case, is divided into a cooking information code of "1 0 2 4 0 1 2" and an error detecting code of "3".

Each element of the cooking information code is assigned with a weight which corresponds to the digit number of the element.

That is, the elements of the cooking information code are assigned with the following weights, respectively:

First element "1" (First digit)—Weight of "1"

Second element "0" (Second digit)—Weight of "2"

Third element "2" (Third digit)—Weight of "3"

Fourth element "4" (Fourth digit)—Weight of "4"

Fifth element "0" (Fifth digit)—Weight of "5"

Sixth element "1" (Sixth digit)—Weight of "6"

Seventh element "2" (Seventh digit)—Weight of "7"

The values of the cooking information code elements are multiplied by the associated weights of the cooking information code elements, respectively. The resultant products are then summed together. The resultant sum is then divided by "10". A balance obtained by the division is determined as an error code or check sum.

That is, the error code is calculated as follows:

$$1\times1+0\times2+2\times3+4\times4+0\times5+1\times6+2\times7=43$$

$$43\div10=4 \text{ (quotient) . . . } 3 \text{ (balance)}$$

Accordingly, the calculated error code is "3". Where all the input cooking information code elements are correct, the cooking information code should be "1 0 2 4 0 1 2 3".

Thereafter, the microcomputer 40 compares the error code calculated at step 120 with the error detecting code of the cooking code input at step 110 by the user (Step 130 of FIG. 4).

When it is determined at step 130 that the error code corresponds to the error detecting code, the microcomputer 40 recognizes that the inputting of the cooking information code by the user is correct without any error. In this case, the microcomputer 40 decodes the input cooking information code in accordance with associated information. Based on the decoded data, the microcomputer 40 then controls the cooking drive unit 30 to execute a desired cooking operation associated with the input cooking code (Step 140 of FIG. 4).

When it is determined at step 130 that the calculated error code (check sum) does not correspond to the error detecting code, the microcomputer 40 recognizes that the inputting of the cooking information code is erroneous. In this case, the microcomputer 40 returns to an initial state while displaying the code input error on the display unit 10, in order to enable the inputting of a correct cooking code (Step 150 of FIG. 4).

The above-mentioned apparatus and method for controlling the cooking operation of a microwave oven using a code system may be conveniently used where cooking codes to be used in cooking a variety of foods using a microwave oven are indicated on packages of those foods, respectively. In this case, a variety of foods can be conveniently cooked in the microwave oven in an optimum state as the user simply input the cooking code indicated on the package of a food to be cooked.

The cooking code indicated on the package of the food may include any types of symbols which can be input and recognized by the user. Such symbols may include, e.g.) Arabic numerals, the English alphabet, the consonants of the Korean alphabet, and the vowels of the Korean alphabet.

The cooking code, which is indicated on the package of a food, may additionally include a code indicative of the manufacturer of the food item or the manufacturer of a microwave oven available for the food item.

As apparent from the above description, the apparatus and method for controlling the cooking operation of a microwave oven using a code system in accordance with the present invention are advantageous in that a variety of foods can be simply and conveniently cooked in an optimum state by use of cooking codes which can be recognized and input by the user. Such cooking codes are indicated on packages of foods to be cooked so that the user inputs those cooking codes upon cooking the associated food items.

In particular, the cooking control apparatus and method of the present invention provide an effect of preventing an erroneous operation of the microwave oven caused by an erroneous inputting of cooking information codes, thereby achieving a cooking operation associated with an accurate information code. Thus, it is possible to achieve an optimum cooking.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for controlling the cooking operation of a microwave oven using a code system, comprising:

input means for manually inputting a cooking code, the cooking code including a cooking data section and a code error detecting section, the code error detecting section including data used to verify accuracy of the cooking code;

processing means, including a memory, for setting information corresponding to the cooking code, the memory storing the set information therein; and control means for decoding the cooking code input through the input means in accordance with the information stored in the memory, and controlling a cooking operation based on the decoded code, wherein the processing means multiplies each of codes of the cooking data section by a predetermined number to verify the accuracy of the cooking code.

2. The apparatus in accordance with claim 1, wherein the cooking data section of the cooking code includes a code associated with a cooking mode, a code associated with a cooking time, a code associated with an output level, and a code associated with a cooking temperature.

3. The apparatus in accordance with claim 1, wherein said processing means compares data from the cooking data section of the cooking code with the data from the code error detecting section of the cooking code.

4. The apparatus in accordance with claim 1, wherein the predetermined number includes one of 1, 2, 3, 4, 5, 6 and 7.

5. The apparatus in accordance with claim 1, wherein the processing means adds results from the multiplications, divides the resultant sum by 10, and generates a remainder value as an error data to be used to verify the accuracy of the cooking code.

6. The apparatus in accordance with claim 5, wherein the processing unit compares the error data with the data from the code error detecting section of the cooking code to verify the accuracy of the cooking code.

7. The apparatus in accordance with claim 6, wherein said processing means displays an error signal on a display unit based on the comparison result.

8. A method for controlling the cooking operation of a microwave oven using a code system, comprising the steps of:

setting information corresponding to a cooking code, the cooking code including a cooking data section and a code error detecting section, the code error detecting section including data used to verify accuracy of the cooking code;

storing the set information;

manually inputting the cooking code; and decoding the cooking code input in said manually inputting step in accordance with the stored information, and controlling a cooking operation based on the decoded code, wherein said decoding step includes the steps of multiplying each of codes of the cooking data section by a predetermined number to verify the accuracy of the cooking code.

9. The method in accordance with claim 8, wherein in said manually inputting step, the cooking code comprises data sets respectively indicative of an output level, a cooking time, a cooking mode and a cooking temperature.

10. The method in accordance with claim 9, further comprising the step of detecting an error in the input cooking code after the execution of said manually inputting step.

11. The method in accordance with claim 8, further comprising the step of detecting an error in the input cooking code after the execution of the cooking code inputting step.

12. The method in accordance with claim 8, wherein in said manually inputting step, the cooking data section of the cooking code includes a code associated with a cooking mode, a code associated with a cooking time, a code associated with an output level, and a code associated with cooking temperature.

13. The method in accordance with claim 8, wherein said decoding step includes:

comparing data from the cooking data section of the cooking code with the data from the code error detecting section of the cooking code.

14. The method in accordance with claim 8, wherein in said multiplying step, the predetermined number includes one of 1, 2, 3, 4, 5, 6 and 7.

15. The method in accordance with claim 8, wherein said decoding step includes:

adding results from said multiplying step, dividing a sum resulting from said adding step by 10, and generating a remainder value resulting from said dividing step as an error data to be used to verify the accuracy of the cooking code.

16. The method in accordance with claim 15, wherein said decoding step includes:

comparing the error data generated from said generating step with the data from the code error detecting section of the cooking code to verify the accuracy of the cooking code.

17. The method in accordance with claim 16, further comprising:

displaying an error signal on a display unit based on a result from said comparing step.

* * * * *